US006966819B2

(12) United States Patent
Carroll

(10) Patent No.: US 6,966,819 B2
(45) Date of Patent: Nov. 22, 2005

(54) INJECTING AN AIR STREAM WITH SUBLIMABLE PARTICLES

(76) Inventor: Robert Andrew Carroll, 978 Palo Alto Ave., Clovis, CA (US) 93612

( * ) Notice: Subject to any disclaimer, the term of this patent is extended or adjusted under 35 U.S.C. 154(b) by 274 days.

(21) Appl. No.: 10/613,838

(22) Filed: Jul. 3, 2003

(65) Prior Publication Data

US 2005/0003741 A1 Jan. 6, 2005

(51) Int. Cl.[7] ..... B24B 49/00

(52) U.S. Cl. ..... 451/7; 451/40; 451/53; 451/99

(58) Field of Search ..... 451/7, 40, 53, 451/99

(56) References Cited

U.S. PATENT DOCUMENTS

| | | | | | |
|---|---|---|---|---|---|
| 1,591,378 | A | * | 7/1926 | Hansen | 406/39 |
| 3,074,822 | A | * | 1/1963 | Walk et al. | 134/7 |
| 4,038,786 | A | | 8/1977 | Fong | |
| 4,389,820 | A | | 6/1983 | Fong | |
| 4,707,951 | A | * | 11/1987 | Gibot et al. | 451/99 |
| 4,744,181 | A | | 5/1988 | Moore | |
| 4,947,592 | A | * | 8/1990 | Lloyd et al. | 451/99 |
| 4,965,968 | A | * | 10/1990 | Kelsall | 451/99 |
| 5,109,636 | A | | 5/1992 | Lloyd | |
| 5,415,584 | A | | 5/1995 | Brooke | |
| 5,492,497 | A | | 2/1996 | Brooke | |
| 6,174,225 | B1 | * | 1/2001 | Becker | 451/75 |
| 6,346,035 | B1 | * | 2/2002 | Anderson et al. | 451/99 |
| 2003/0143929 | A1 | * | 7/2003 | Schmidt | 451/40 |

* cited by examiner

*Primary Examiner*—M. Rachuba

(57) ABSTRACT

Apparatus and method to inject an air stream with dry ice or other sublimable particles to be blasted against a surface to be cleaned. An air lock assembly (20) with an air stream passage (21) and an intersecting conveyor passage (13) that has an endless cable conveyor assembly (38) passing through it. The conveyor (38) passes through a hopper (30) of dry ice particles before entering the air lock (20) and injecting the air stream with dry ice particles. V-seals packings (18) are provided as a means of limiting air form escaping from the points where the conveyor (38) enters and exits the air lock assembly (20). An adjustable speed motor (10) drives the conveyor (38) thereby giving an adjustable control of the ratio of dry ice to air.

11 Claims, 5 Drawing Sheets

INJECTING AN AIR STREAM WITH SUBLIMABLE PARTICLES

FEDERALLY SPONSORED RESEARCH

Not Applicable

SEQUENCE LISTING OR PROGRAM

Not Applicable

BACKGROUND

1. Field of the Invention

Apparatus and method for preparing and injecting an air stream with dry ice particles or other sublimable particles to be blasted against a surface to be cleaned.

2. Description of Prior Art

Blasting or cleaning a surface with a stream of high-pressure air mixed with sublimable particles is a well-known art. The most used blast media for this purpose is dry ice particles of various sizes. Dry ice is the solid form of carbon dioxide. One of the advantages of using dry ice over other media such as silica sand, glass beads or steel grit is that upon impact the dry ice instantly returns to a gas state leaving no residue to collect or dispose of Dry ice is also much more forgiving on the surfaces it impacts compared to many other media.

In the case of traditional media, both the media and contaminate being removed must be collected and disposed of properly. If the contaminate is a hazardous substance the used media will also have to be treated as a hazardous substance thereby creating more hazardous waste to contended with. Only the contaminant being cleaned off a surface must be disposed of when dry ice blasting is used thus creating less waste then traditional media blast cleaning systems.

Dry ice blasting can and does replace dangerous and environmentally unfriendly cleaning chemicals thereby reducing the exposure of humans and the environment to these chemicals.

Reducing the use of these chemicals also reduces the chance of improper disposal of chemicals into the environment and improves air quality by eliminating the volatile organic chemicals emitted into the air by many cleaning chemicals.

The art includes two generally available types of dry ice blasting systems that use high-pressure air to facilitate the blasting. The two hose system uses two hoses to transport the air and dry ice separately to a ventri suction type blast nozzle where they are mixed. The second type carries the air and dry ice together in one hose to the blast nozzle. The single hose systems, as they are known, use some type of mechanical means to inject or feed dry ice into the air stream at a source of dry ice to be carried to a blast nozzle by one hose.

One advantage of the single hose system is that they generally produce more blasting power then two hose systems of similar size. The single hose systems also have an ergonomical advantage in that the user must manipulate only one hose to facilitate blasting thus significantly reducing the weight he or she must support.

Dry ice is readily available commercially in various forms including block, nugget, and rice. All forms of dry ice can be used for blasting, but block and sometimes nugget types require additional processing to produce dry ice particles of appropriate size for use in blasting. The rice form is the smallest commercially available form of dry ice particles and requires no additional processing as most dry ice blasting machines are designed to use it.

The problem of how to inject dry ice particles into a stream of air is made difficult by the very problematic nature of dry ice. Dry ice chills or freezes most things it comes in contact with or in close proximity to including the vary mechanisms used to act upon it because of its very low temperature (−78° C./−109° F.). This low temperature can lead to condensation or frozen condensation on or inside the equipment and can, through thermal contraction, substantially change the dimensions of critical components. Therefore it is important to avoid mechanically complex designs in this art in order to maintain good reliability.

Dry ice also attracts moisture from the air to its surface were it freezes and degrades its quality. Dry ice particles tend to aggregate into clumps, especially when moisture is present. Once aggregated into clumps it is difficult or impossible to feed through conventional mechanisms of the art.

Manufactures and users of dry ice blasters are all aware of the difficulties of injecting dry ice into a stream of air. The art has many examples of attempts to overcome these difficulties and to improve the art. The art of injecting dry ice particles into a stream of air would appear to be a simple problem to over come. However the fact that there continues to be efforts to overcome the inherent problems of this art indicates there is still room for improvement in the art of dry ice blasting.

The most important problems in the art that need to be overcome are the problems with the inability to consistently feed a metered amount of dry ice particles into a stream of air to create a consistent ratio of dry ice to air in the blast hose at all times. Often the feed of dry ice is intermittent and inconstant in the present art. A second problem that needs to be addressed is the fact that most of the art relies on complicated and therefore relatively expensive mechanisms to overcome the aforementioned problem. The price of equipment keeps this environmentally friendly method of cleaning out of the hands of the individuals and small and medium sized companies who often continue to depend on cleaning methods that are less friendly to the environment then dry ice blasting.

A device that both consistently feeds and accurately meters dry ice into the air stream via an air lock must solve the problem. Several devices are known that try to perform both functions by using moving elements with cavities that are filled with dry ice particles and then attempt to supply the dry ice into the air stream. For example, star wheels, reciprocating plates and rotary disks with cavities move at a given frequency past a dry ice feed station and then move to alien the dry ice filled cavity with the flow of the air stream to discharge it and mix dry ice into the air stream.

U.S. Pat. No. 4,947,592 (1990) and U.S. Pat. No. 5,109,636 (1992) both to Lloyd disclose a star wheel design and U.S. Pat. No. 5,415,584 (1995) and U.S. Pat. No. 5,492,497 (1996) both to Brooke and U.S. Pat. No. 4,744,181 (1988) to Moore disclose reciprocating plate(s) designs. Both design types feed dry ice and meter dry ice into the air stream with similar mechanisms. In these cases the cavities of the wheel and reciprocating plates are fixed in size. The only way to adjust the ratio of dry ice to air is to adjust the frequency at which the cavities are brought into alignment with the air stream. This works only in restricted limits.

Problems arise as the ratio of dry ice to air is reduced. To accomplish this, the rotating wheel or the reciprocating plate(s) must be slowed to decrease the discharge frequency. This slowing tends to create an undesirable pulsing of dry ice in the blast hose and at the nozzle when the cavities are not aligned with the airflow stream.

Another problem with the above designs is the fact that as the cavities turn or move slower the greater the chance that the dry ice in them will aggregate into clumps that can not be discharged into the air stream. These clumps often freeze in the cavities thereby increasing the undesirable pulsing of dry ice. If all the cavities become clogged in this way the mechanism will fail to operate. If the mechanism is stopped for a period of time the dry ice that remains in the cavities, that has not yet been discharged into the air stream, may freeze in the cavities and cause pulsing or may freeze the mechanism so that it cannot be restarted.

U.S. Pat. No. 6,346,035 (2002) to Anderson discloses a device that claims to have overcome the above problems, but in reality the devise still faces several of the above problems with an added one that effects the safety of the operator and those in proximity to the operating blaster. This design uses an auger to feed and meter dry ice into a rotating air lock that feeds the dry ice into the air stream. The rotating air lock rotates at a set speed thereby reducing the pulsing effect caused by changing the frequency at which the cavities are discharged in the above-mentioned art. On shut down the auger stops feeding dry ice to the air lock, but the air lock continues to rotate and the stream of high pressure air continues for a set time. This eliminates the possibility of dry ice freezing in the rotor's feed cavities, but more importantly it creates an unsafe condition. Most regulatory agencies require a "dead man" device on abrading blast cleaning equipment that is to promptly stop the flow of air and abrading media when the operator removes his or her bodily input that keeps the machine operating. The continued airflow and diminishing dry ice flow after shut down of this design negates the function of any "dead man" safety device. The auger feed mechanism of this design is also susceptible to being jammed or clogged by aggregated clumps of dry ice as the above-mentioned art.

U.S. Pat. No. 6,346,035 (2002) to Anderson and U.S. Pat. No. 4,947,592 (1990) and U.S. Pat. No. 5,109,636 (1992) both to Lloyd all require the use of two motors to inject dry ice into the air stream going to the cleaning nozzle. By using two motors the designs uses excessive energy that could have been used directly for the cleaning action. Using two motors also makes the machines more complex and thereby reduces reliability.

Known prior art suffers from a number of the following disadvantages:

(a) The ratio of dry ice to pressurized air is a set ratio or is sometimes limited to a narrow adjustment of the ratio. Limited ratios restrict the flexibility to use the art in cleaning applications.
(b) Pulsing of dry ice from the blast nozzle is a negative possibility in several of these designs.
(c) The designs are complex with many intricate moving parts that are specific to each design.
(d) Two of the designs include multiple motors that reduce the energy that can be used for cleaning.
(e) The designs have a relatively high number of parts that are complex in nature. These complex designs increase manufacturing costs by increasing the need for more manufacturing/warehouse space, manufacturing plant equipment, and highly trained employees.
(f) The designs have tendencies to become clogged with aggregated clumps of dry ice.
(g) The designs must keep parts dimensionally within tolerance to avoid the negative effects of the extreme low temperature. The low temperature can change the dimensions of some parts so drastically that thy can no longer function properly.
(h) The designs must continue to purge pressurized air from the nozzle after the actuation trigger is released to remove dry ice from the system thus causing a safety hazard.

OBJECTS AND ADVANTAGES

Accordingly several objects and advantages of my invention are:

(a) A design that will inject dry ice into an air stream at a wide range of air to dry ice ratios with no pulsation of dry ice in the hose and nozzle.
(b) A design that is significantly simpler with fewer elements then previous art.
(c) A design that uses only one drive motor.
(d) A design that is significantly less expensive to manufacture then previous art.
(e) A design that is resistant to being jammed or clogged by aggregated clumps of dry ice.
(f) A design that is resistant to the effect of low temperatures.
(g) A design that is self-clearing of dry ice particles so that upon stoppage no dry ice will remain to clog or bind the system.
(h) A design that can safely stop the flow of air and dry ice promptly on shut down.

Further objects and advantages of my invention will become apparent from a consideration of the following drawings and descriptions.

SUMMARY

A system according to this invention includes a source of dry ice particles or other suitable particles, a regulated source of pressurize air, and an air lock mixing element receiving and combining both dry ice particles and air. An adjustable speed drive motor with a drive sprocket and an idler sprocket move an endless loop conveyor cable assembly through the dry ice source and carry it into the air lock where it is mixed with a air stream. A hose and a nozzle to receive the air laden with dry ice particles from the air lock mixing element to discharge the air laden with dry ice particles toward the object to be cleaned.

DRAWINGS

Drawings Figures

REFERENCE NUMERALS IN DRAWINGS

Figure 1:
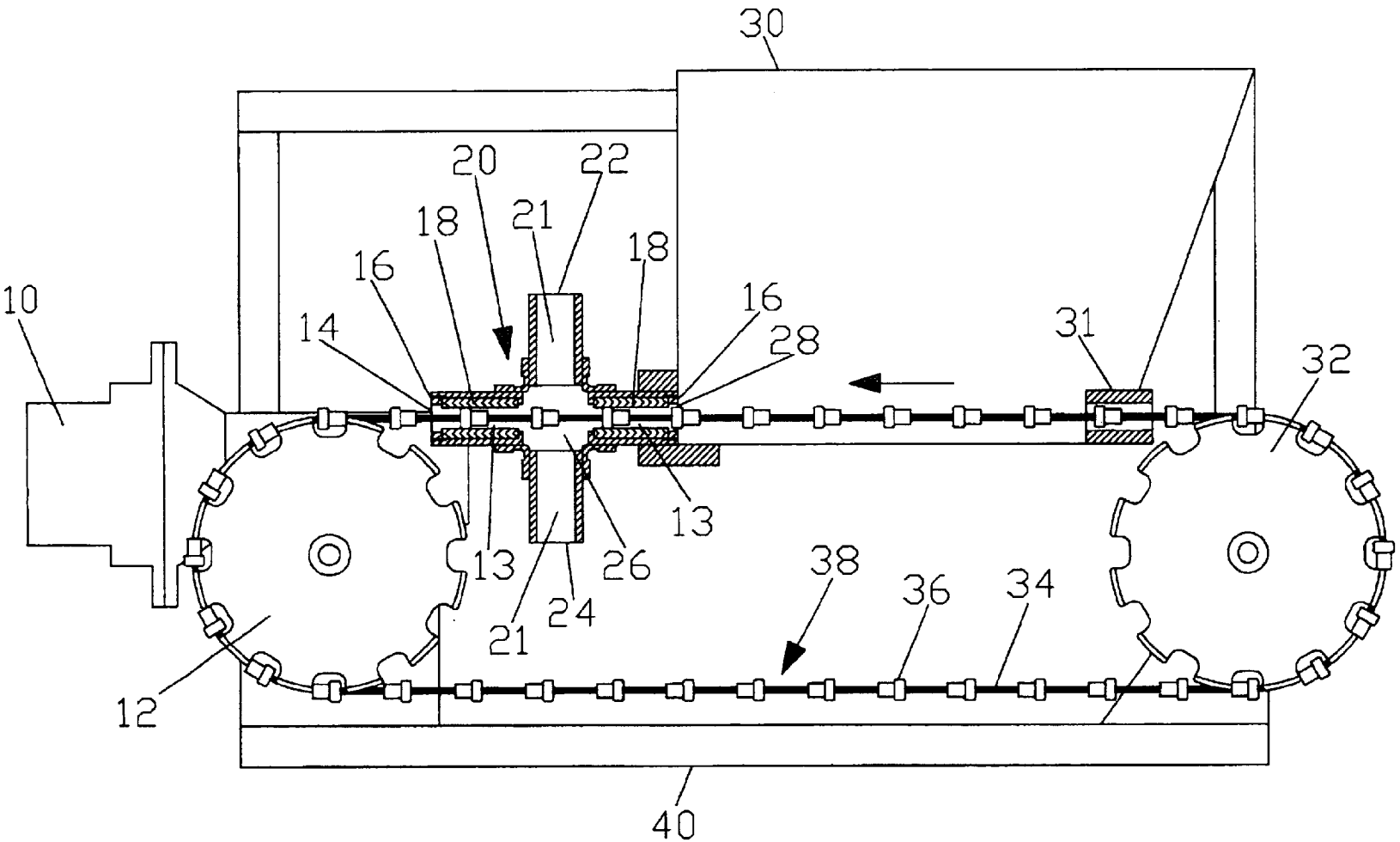
FIG. 1 shows a side view, partly in cross-section, of a preferred embodiment of the invention in a horizontal configuration.

10 Adjustable speed motor
12 Drive sprocket

13 Conveyor passage
14 Conveyor cable outlet
16 Seal adjustment stop
18 V-seal packing
20 Air lock assembly
21 Air passage
22 Inlet port
24 Outlet port
26 Mixing chamber
28 Conveyor cable inlet
30 Horizontal dry ice hopper
31 Hopper port
32 Idler sprocket
34 Wire rope
36 Conveyor airlock piston
38 Conveyor cable assembly
40 Frame
42 Vertical dry ice hopper
43 Enlarged vertical dry ice hopper
44 Angled dry ice hopper

DETAILED DESCRIPTION

FIG. 1 Preferred Embodiment

A horizontal dry ice hopper 30 is mounted on a frame 40. The frame supports an adjustable speed motor 10 and an idler sprocket 32. An air lock assembly 20 is supported by horizontal dry ice hopper 30, but also can be alternately supported by frame 40 or plumbing that rigidly supports air lock assembly 20 between adjustable speed motor 10, horizontal dry ice hopper 30, and idler sprocket 32.

A conveyor cable assembly 38 is routed horizontally in a path along the bottom of horizontal dry ice hopper 30 through air lock assembly 20 around a drive sprocket 12 around idler sprocket 32 through a hopper port 31 and back into horizontal dry ice hopper 30.

Horizontal dry ice hopper 30 is a wedge shape with the "V" shape of the wedge facing downward. The "V" shape forms a horizontal valley along the inside bottom of hopper 30. Conveyor cable assembly 38 travels along the valley from hopper port 31 to air lock assembly 20.

Conveyor cable assembly 38 is constructed by attaching a plurality conveyor airlock pistons 36 equally spaced apart to a section of wire rope 34 to form a continuous loop. Conveyor airlock pistons 36 are a cylindrical shape with a hole centered through the length of the piston to facilitate the passage of wire rope 34. A portion of the cylindrical shape of conveyor airlock pistons 36 has a reduced diameter to facilitate the crimping of pistons 36 to wire rope 34. The crimps should firmly attach pistons 36 to wire rope 34 forming a seal between wire rope 34 and the hole through each piston.36 to restrict the flow of air between the two. The ends of wire rope 34 are spliced together utilizing one or more of the crimps that attach the pistons 36 to wire rope 34 after being fed through hopper 30 and air lock assembly 20 to create the endless loop feature of conveyor cable assembly 38.

The diameter of conveyor airlock pistons 36 and the space between them must be considered along with the speed range of adjustable speed motor 10 in establishing the maximum and minimum feed rate of dry ice that will be possible with this invention. Larger diameter pistons 36 generally will increase the feed rate of dry ice and increase the size of dry ice particles that can be fed through the invention. Spacing pistons 36 to close together will both decrease the feed rate of dry ice and the efficiency of feeding dry ice into air lock assembly 20 at higher motor speeds.

Hopper port 31 is a section of tubing with an inside diameter larger then the diameter of conveyor airlock pistons 36. Hopper port 31 is longer then the distance between any two adjacent conveyor airlock pistons 36.

Figure 2:
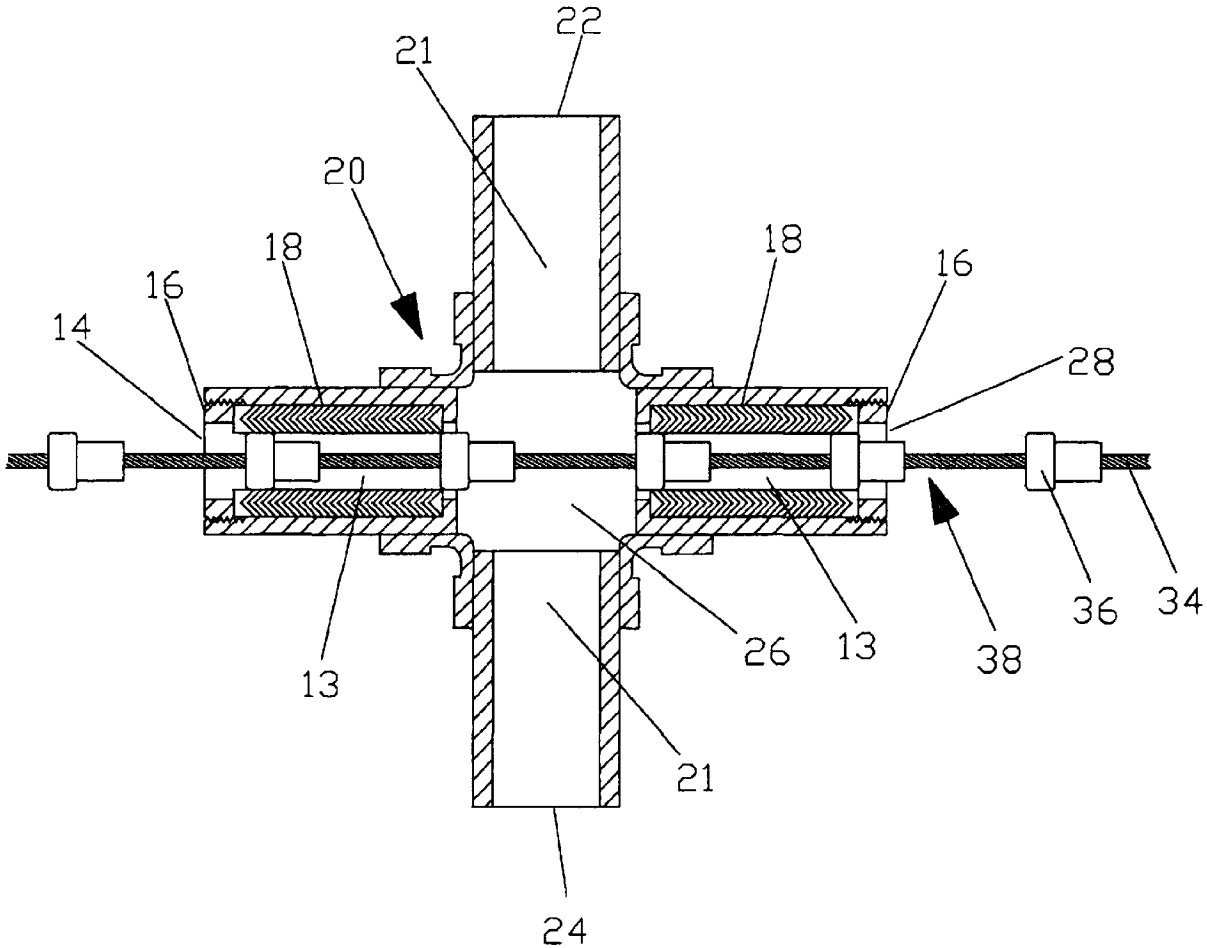
FIG. 2 shows a detailed cross-section of an air lock assembly used in this invention.

FIG. 2 Air Lock Assembly

FIG. 2 shows air lock assembly 20 is constructed with two tubular passages intersecting each other at a 90° angle. The center axes of both passages are on the same plane. A mixing chamber 26 is formed were the passages intersect each other. An air passage 21 has an inlet port 22 at one end and an outlet port 24 at the opposite end. A conveyor passage 13 has a conveyor cable inlet 28 at one end and a conveyor cable outlet 14 at the opposite end.

Conveyor cable inlet 28 is constructed to accept a v-seal packing 18. The mixing chamber 26 end of conveyor cable inlet 28 the inside diameter is reduced to secure v-seal packing 18 from moving into mixing chamber 26. The outward-facing end of conveyor cable inlet 28 is threaded on the inside diameter to accept a seal adjustment stop 16.

Conveyor cable outlet 14 is constructed to accept v-seal packing 18. The mixing chamber 26 end of conveyor cable outlet 14 the inside diameter is reduced to secure v-seal packing 18 from moving into mixing chamber 26. The outward-facing end of conveyor cable outlet 14 is threaded on the inside diameter to accept seal adjustment stop 16.

Seal adjustment stops 16 are rings threaded on the outside diameter to fit the threaded inside area of conveyor cable inlet 28 and conveyor cable outlet 14. The inside diameter is larger then the diameter of conveyor airlock pistons 36.

V-seal packing 18 should be longer then the distance between two adjacent conveyor airlock pistons 36 and are installed behind seal adjustment stops 16 in conveyor cable inlet 28 and conveyor outlet 14. Cable conveyor assembly 38 passes through conveyor cable inlet 28, v-seal packings 18, and conveyor outlet 14. V-seal packings 18 are installed in the conveyor cable inlet 28 and conveyor outlet 14 so that the lip of each seal that make up packing is facing toward mixing chamber 26 and the "V" point shape of each seal is pointing outward from air lock assembly 20. V-seal packing 18 is PTFE or similar fluoropolymer.

Air lock assembly 20 can be rotated 360 degrees around cable conveyor assembly 38 axes to facilitate plumbing of inlet port 22 and outlet port 24 to the completed dry ice blasting machine.

Inlet port 22 of air lock assembly 20 is supplied with regulated air pressure. Outlet port 24 is connected to a hose and blast nozzle (not shown) to receive the stream of air laden with dry ice particles from air lock assembly 20.

A conventional switch to simultaneously start and stop the flow of regulated air pressure to inlet port 22 and rotation of adjustable speed motor 10 is provide on the blast nozzle (not shown) or other suitable location.

Figure 3:
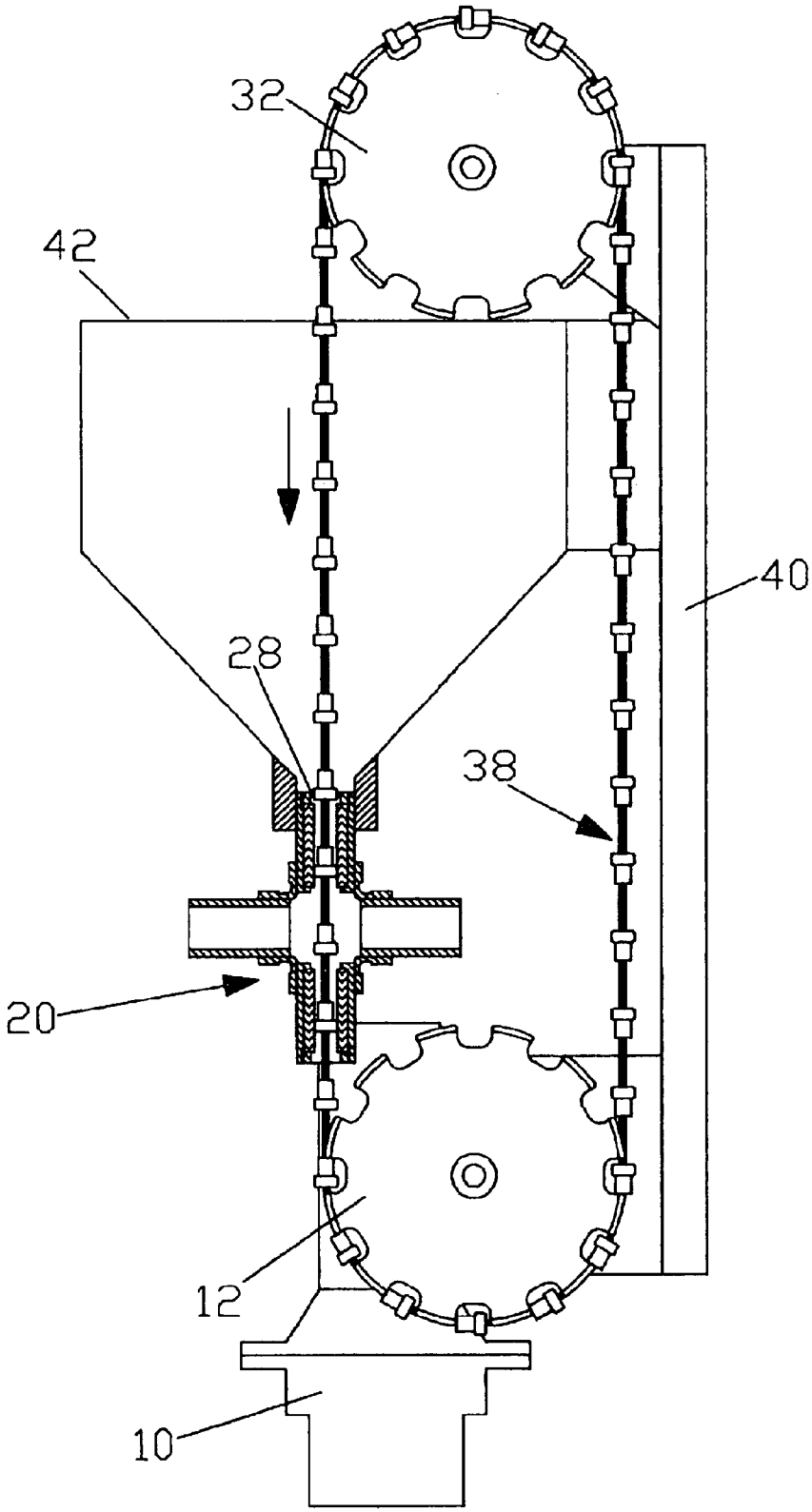
FIG. 3 shows a side view, partly in cross-section, of an additional embodiment of the invention in a vertical configuration.

FIG. 3 Additional Embodiment

An additional vertical embodiment is described here and shown in FIG. 3. The description is the same as the above-mentioned horizontal embodiment with the following differences. A vertical dry ice hopper 42 is mounted on frame 40. Frame 40 supports adjustable speed motor 10 on the lower section and idler sprocket 32 on the top. Air lock assembly 20 is supported by vertical dry ice hopper 42, but also can be alternately supported by frame 40 or plumbing that rigidly supports air lock assembly 20 between adjustable speed motor 10, vertical hopper 42 and, idler sprocket 32.

Conveyor cable assembly 38 is routed vertically in a path down through the center axis of vertical dry ice hopper 42, through air lock assembly 20, around drive sprocket 12, up and around to idler sprocket 32 and back down into vertical hopper 42. Vertical hopper 42 is an inverted pyramid or cone shape. The shape of vertical hopper 42 funnels down into conveyor cable inlet 28 of air lock assembly 20.

Figure 4:
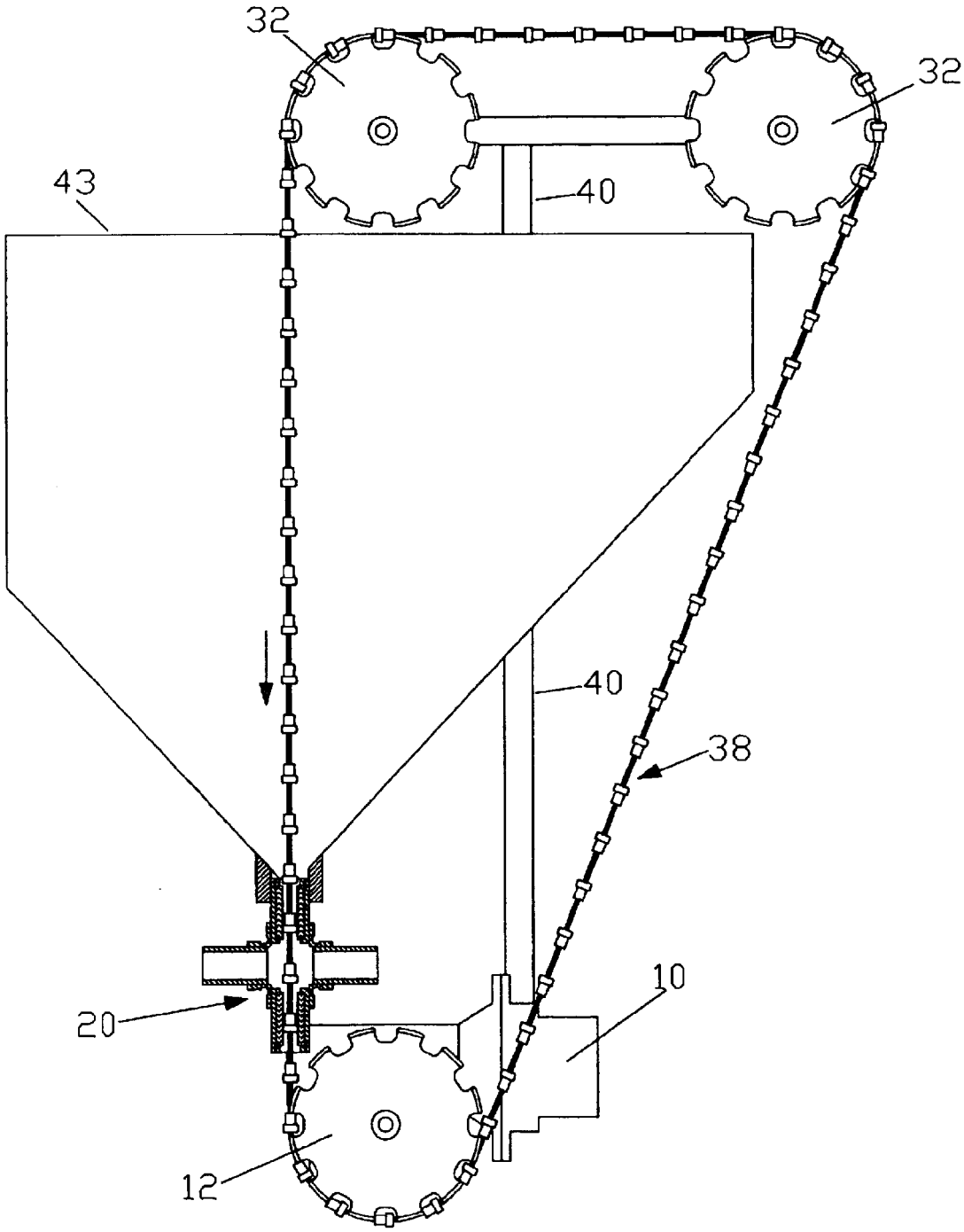
FIG. 4 shows a side view, partly in cross-section, of an alternative embodiment of the invention in an enlarged vertical configuration.
Figure 5:
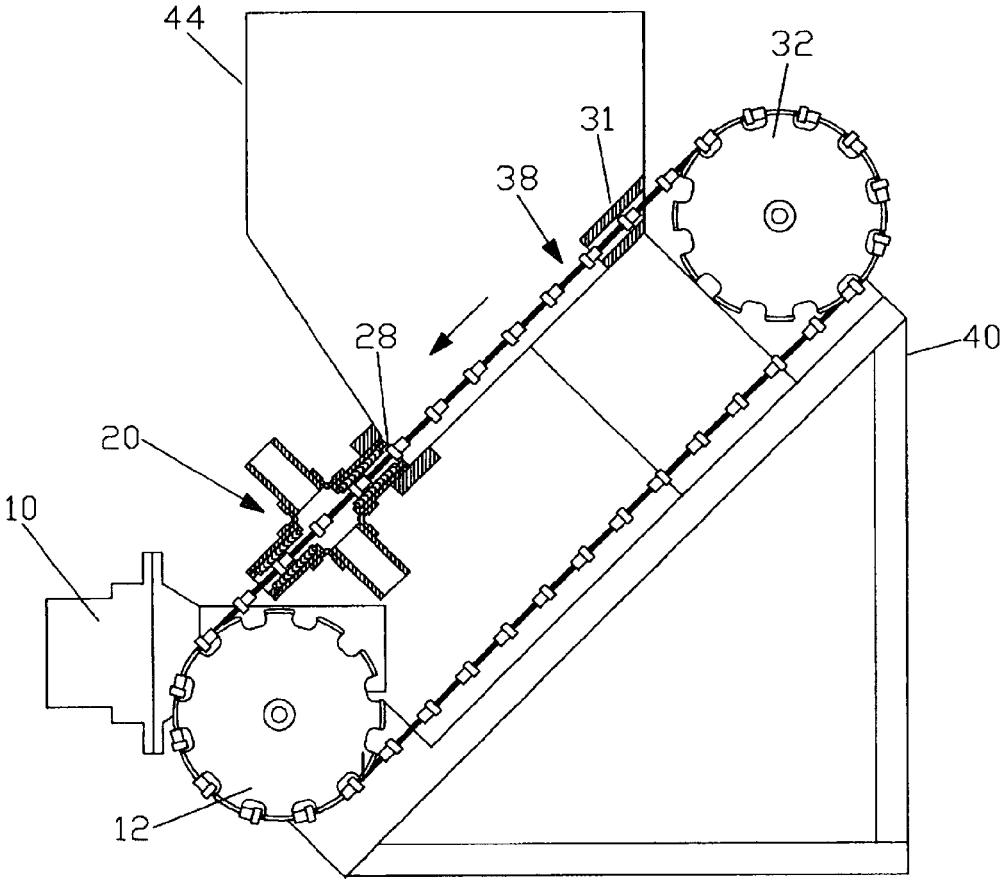
FIG. 5 shows a side view, partly in cross-section, of an alternative embodiment of the invention in an angled configuration.

FIGS. 4 and 5 Alternative Embodiments

There are numerous possibilities with regard to the relative layout of this invention and the routing of its conveyor cable assembly 38. Two of these possibilities are described below and shown in FIG. 4 and 5. An enlarged vertical dry ice hopper 43 or an angled dry ice hopper 44 may be used. Multiple idler sprockets 32 may be used. Adjustable speed motor 10 and drive sprocket 12 may be located anywhere along the route of conveyor cable assembly 38.

FIG. 4 shows an alternative enlarged vertical embodiment of the invention with two idler sprockets 32 used to facilitate the use of enlarged vertical hopper 43.

FIG. 5 shows an alternative angled embodiment of the invention. This embodiment of the invention routes conveyor cable assembly 38 at an angle down through angled dry ice hopper 44 and then into air lock assembly 38. Angled dry ice hopper 44 is an inverted pyramid or cone shape. Conveyor cable assembly 38 enters angled hopper 44 through hopper port 31. The shape of angled hopper 44 funnels down into conveyor cable inlet 28 of air lock assembly 20.

FIGS. 1 and 2 Operation of Preferred Embodiment

Conveyor cable assembly 38 is pulled, by adjustable speed motor 10 via drive sprocket 12, through a supply of dry ice particles that is contained in horizontal dry ice hopper 30. A metered amount of dry ice particles is entrapped between conveyor airlock pistons 36 as conveyor cable assembly 38 is pulled through the dry ice. As conveyor cable assembly 38 leaves the hopper it enters conveyor cable inlet 28 of air lock assembly 20 bringing with it the metered amount of dry ice that is entrapped between pistons 36.

A stream of regulated pressurized air is only supplied to inlet port 22 while adjustable speed motor 10 is running. Inlet port 22 supplies air to mixing chamber 26.

As each of conveyor airlock pistons 36 enters conveyor cable inlet 28 and its v-seal packing 18 a seal is created to prevent pressurized air from escaping from mixing chamber 26 via conveyor cable inlet 28. The seal is maintained as each conveyor airlock piston 36 travels through the v-seal packing 18 until the following conveyor airlock piston 36 on conveyor cable assembly 38 engages v-seal packing 18, thereby creating an uninterrupted air lock seal. As each piston 36 leaves v-seal packing 18 of conveyor cable inlet 28 it exposes the dry ice entrapped between it and the following conveyor airlock piston 36 to the pressurized air stream in mixing chamber 26. As the dry ice is exposed to the air stream it is mixed and carried away via the outlet port 24.

As each conveyor airlock pistons 36 enters conveyor cable outlet 14 and its v-seal packing 18 from mixing chamber 26 a seal is created to prevent pressurized air from escaping from mixing chamber 26 via conveyor cable outlet 14. The seal is maintained as each conveyor airlock piston 36 travels through v-seal packing 18 of conveyor cable outlet 14 until following conveyor airlock piston 36 on conveyor cable assembly 38 engages v-seal packing 18 thereby creating an uninterrupted air lock seal.

After conveyor cable assembly 38 leaves air lock assembly 20 it continues on a route around drive sprocket 12 and idler sprocket 32 before it re-enters horizontal dry ice hopper 30 via hopper port 31.

FIGS. 3–5 Additional and Alternative Operation

The additional and alternative embodiments operate the same as the preferred embodiment described above with the exception of the following differences.

In the additional vertical embodiment shown in FIG. 3 after conveyor cable assembly 38 is pulled from air lock assembly 20 it continues on a route around drive sprocket 12 and idler sprocket 32 before it re-enters vertical dry ice hopper 42 via its open top.

In the alternative enlarged vertical embodiment shown in FIG. 4 after conveyor cable assembly 38 is pulled from air lock assembly 20 it continues on a route around drive sprocket 12 and two idler sprockets 32 before it re-enters enlarged vertical dry ice hopper 43 via its open top.

In the alternative angled embodiment shown in FIG. 5 after conveyor cable assembly 38 is pulled from air lock assembly 20 it continues on a route around drive sprocket 12 and idler sprocket 32 before it re-enters angled dry ice hopper 44 via hopper port 31.

CONCLUSION, RAMIFICATION, AND SCOPE

Accordingly, the reader will see that the injecting apparatus of this invention is a simple design that has many advantages over all previous art including:

- A design that can be adjusted to provide a large range of ratios of air to dry ice supplied to the blast hose and nozzle.
- No pulsation of dry ice in the blast hose and nozzle.
- Simple design that increases reliability and ease of manufacture by using significantly fewer elements then previous art.
- Only one drive motor is used in order to reserve the energy supplied to the machine for the cleaning action.
- A design that is significantly less expensive to manufacture then previous art.
- Resistant to being jammed or clogged by aggregated clumps of dry ice.
- Resistant to the effects of low temperatures.
- A design that is self-clearing of dry ice particles so that upon stoppage no dry ice will remain to clog or bind the system.
- A design that safely stops the flow of air and dry ice promptly when shut down.

Although the description above contains much specificity, these should not be construed as limiting the scope of this invention but as merely providing illustrations of some of the presently preferred embodiments of this invention. For example the conveyor cable assembly 38 can take many more paths then described, the sprockets can take different shapes, the hoppers can take many different shapes and sizes, and the over all layout can take on many different configurations.

Thus the scope of the invention should be determined by the appended claims and their legal equivalents, rather than by the examples given.

I claim:

1. Device for injecting sublimable particles into a pressurized stream of gas comprising:

an endless rotational energy connecting element passing over a driven rotational transmission member and one or more idle rotational transmission members with a plurality of conveying members attached to said endless rotational energy connecting element that passes through a supply of sublimable particles conveying with it sublimable particles before passing through an airlock assembly, said airlock assembly comprised of a passage to receive pressurized gas at one end and discharge it mixed with sublimable particles at the opposite end and a second passage intersecting the first passage that said endless rotational energy connecting element passes through with a means to restrict gas from escaping where said endless rotational energy connecting element enters and exits said second passage.

2. The device of claim 1 wherein said an endless rotational energy connecting element passing over a driven rotational transmission member and one or more idle rotational transmission members with a plurality of conveying members attached to said endless rotational energy connecting element is a driven endless conveyor.

3. The device of claim 2 wherein said driven endless conveyor is an adjustable speed cable type conveyor.

4. The device of claim 1 wherein said endless rotational energy connecting element is a cable.

5. The device of claim 1 wherein said means to restrict gas from escaping where said endless rotational energy connecting element enters and exits said second passage is a plurality of v-seals inside both ends of said second passage.

6. The device of claim 5 wherein said plurality of v-seals are made of PTFE.

7. A blast cleaning apparatus for use with sublimable media, a source of pressurized gas, and a nozzle, said blast cleaning apparatus comprising:

an air lock assembly comprised of a passage to receive pressurized gas at one end and to discharge it mixed with sublimable particles at the opposite end and a second passage intersecting the first that has an endless conveyor passing through it with a means to restrict the leakage of gas past the points where said endless conveyor enters and exits said second passage, said endless conveyor has a plurality of attached conveyor members passing over a driven sprocket and one or more idler sprockets that passes through a supply of sublimable particles conveying said sublimable particles into said air lock assembly.

8. The device of claim 7 wherein said means to restrict the leakage of gas past the points where said endless conveyor enters and exits said second passage is a plurality of v-seals inside both ends of said second passage.

9. The device of claim 8 wherein said plurality of v-seals are made of PTFE.

10. The device of claim 7 wherein said endless conveyor is an adjustable speed cable type conveyor with a plurality of disk shaped conveying members attached.

11. A method to inject sublimable particles into a pressurized stream of gas, comprising the steps of:

(a) providing a stream of pressurized gas, (b) providing a gas passage, (c) passing said stream of pressurized gas through said gas passage, (d) providing a second passage that intersects said gas passage, (e) providing an endless loop conveyor that passes through a supply of sublimable particles before passing through said second passage, (f) providing a means to restrict the leakage of gas past the points where said endless loop conveyor enters and exits said second passage, and (g) injecting said steam of pressurized gas with said sublimable particles with said endless loop conveyor, whereby said stream of pressurized gas is injected with sublimable particles.

* * * * *